US008844086B2

(12) United States Patent
Jaeger

(10) Patent No.: US 8,844,086 B2
(45) Date of Patent: Sep. 30, 2014

(54) FLUID ROTATION DRIVE

(76) Inventor: Anton Jaeger, Senden (DE)

( * ) Notice: Subject to any disclaimer, the term of this patent is extended or adjusted under 35 U.S.C. 154(b) by 200 days.

(21) Appl. No.: 13/271,798

(22) Filed: Oct. 12, 2011

(65) Prior Publication Data

US 2012/0090106 A1 Apr. 19, 2012

(30) Foreign Application Priority Data

Oct. 15, 2010 (DE) ..... 10 2010 048 622

(51) Int. Cl.
*A46B 13/06* (2006.01)

(52) U.S. Cl.
CPC ..... *A46B 13/06* (2013.01)
USPC ..... 15/29

(58) Field of Classification Search
CPC ..... A46B 13/06
See application file for complete search history.

(56) References Cited

U.S. PATENT DOCUMENTS

| | | | | |
|---|---|---|---|---|
| 1,839,768 | A | 1/1932 | Major | |
| 4,374,444 | A | 2/1983 | Zhadanov | |
| 4,597,127 | A | 7/1986 | Swanson | |
| 5,007,127 | A * | 4/1991 | Paolo | 15/29 |
| 6,861,769 | B1 | 3/2005 | Brys et al. | |
| 2003/0028982 | A1 | 2/2003 | Kress | |
| 2008/0172810 | A1 * | 7/2008 | Jaeger | 15/21.1 |

FOREIGN PATENT DOCUMENTS

| | | | |
|---|---|---|---|
| DE | 26 56 255 | A1 | 6/1978 |
| DE | 33 31 402 | A1 | 3/1985 |
| DE | 103 51 880 | B3 | 5/2005 |
| DE | 20 009 008 001 | U1 | 6/2009 |
| EP | 2147625 | A1 | 1/2010 |
| JP | 2000 219107 | | 8/2000 |
| NL | 9 101 373 | | 3/1993 |

OTHER PUBLICATIONS

Translation of German Search Report dated Sep. 20, 2012 relating to German Patent Application No. 10 2010 048 622.1.
Translation of European Search Report dated Jan. 17, 2012 relating to EP No. 11185190.3-2318.

* cited by examiner

*Primary Examiner* — Monica Carter
*Assistant Examiner* — Stephanie Berry
(74) *Attorney, Agent, or Firm* — Gifford, Krass, Sprinkle, Anderson & Citkowski, P.C.

(57) ABSTRACT

A fluid rotation drive, in particular for cleaning apparatus, having at least one drive wheel, in particular a turbine wheel or bucket wheel, which can be directly set into rotation about a drive axis by the action of a supplied fluid, in particular supplied in jet form; having at least one planetary transmission, with a sun gear of the planetary transmission being connected to the drive wheel; and having a housing which includes the drive wheel and the planetary transmission and which has at least one inlet for the fluid supplied for acting on the drive wheel, with a first ring region for the fluid being defined by the drive wheel and the housing and a second ring region for the fluid being defined by a toothed arrangement of an annulus gear of the planetary transmission, and with the first ring region and the second ring region being arranged in direct spatial proximity to one another.

20 Claims, 6 Drawing Sheets

FLUID ROTATION DRIVE

Figure 1:
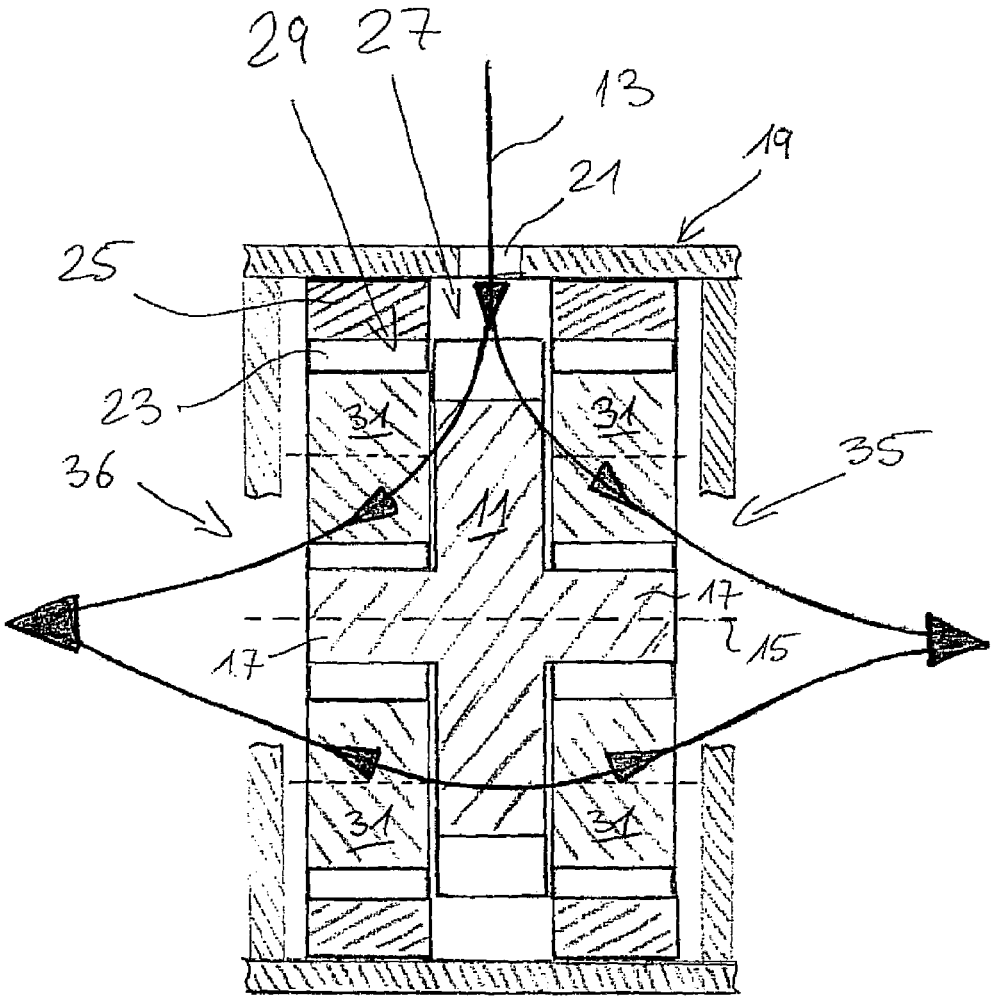

The invention relates to a fluid rotation drive, in particular for cleaning apparatus, having at least one drive wheel, in particular a turbine wheel or bucket wheel, which can be directly set into rotation about a drive axis by the action of a supplied fluid, in particular supplied in jet form, and having at least one planetary transmission, with a sun gear of the planetary transmission being connected to the drive wheel.

Such drives are generally known. It is of disadvantage with such drives that they have jerky running properties in practice. It has in particular been found that the speed of rotation is not stable. This is expressed in a "revving up" of the driven work unit, e.g. a cleaning brush or a cleaning roller, that is an uncontrolled and above all unwanted increase in the speed of rotation when the brush or roller is raised, i.e. runs without load. In addition, such drives react extremely sensitively to external influences such as in particular load changes.

It is the object of the invention to provide a fluid rotation drive of the initially named kind which has a running behavior which is as smooth as possible with a speed of rotation as stable as possible with respect to external influences.

This object is satisfied by the features of claim 1.

In accordance with the invention, the fluid rotation drive includes a housing which includes the drive wheel and the planetary transmission and which has at least one inlet for the fluid supplied for acting on the drive wheel, with a first ring region for a fluid being defined by the drive wheel and the housing and a second ring region for the fluid being by a toothed arrangement of an annular gear of the planetary transmission, and with the first ring region and the second ring region being arranged in direct spatial proximity to one another.

It has surprisingly been found that an extremely smooth running behavior at a practically constant speed of rotation results by the spatial proximity of these two ring regions which is in particular independent of whether the respective driven work unit is loaded or is rotating substantially without a load. In addition, the arrangement in accordance with the invention has proven to be extremely stable with respect to external influences which act on the respective driven work unit. It has furthermore been found that an advantageous "power reserve" is present which provides that the speed of rotation also remains constant when an increased load occurs during work, for example when a user presses the driven cleaning brush or cleaning roll onto a surface to be cleaned with increased force.

The advantageous effect of the arrangement in accordance with the invention is explained in that, due to the housing, that is the structure which is in this sense closed in comparison with known arrangements, the fluid acting on the drive wheel cannot escape in an uncontrolled manner as is the case with known fluid rotation drives so that a ring flow arises, on the one hand, which is braked by the toothed arrangement of the annular gear, on the other hand. Stable flow relationships which are largely independent of external influences are adopted overall in the housing. Experiments have shown that, for example, a reduction in diameter of the drive wheel with an otherwise unchanged arrangement no longer results in the mentioned smooth running properties. It can thus be assumed that it is the combination of a closed structure in particular achieved by the housing, on the one hand, and the spatial proximity of the mentioned ring regions, on the other hand, which provides the explained advantageous effect.

Possible embodiments of the invention are also set forth in the dependent claims, in the description and in the drawing.

The first ring region and the second ring region can be arranged directly next to one another in the axial direction.

Provision can furthermore be made that the first ring region and the second region have at least substantially the same radial spacing from the drive axle.

In an embodiment of the invention, the planet gears of the planetary transmission are arranged at a common carrier which can be set into rotation by means of the sun gear.

An axial outlet for the fluid is preferably provided.

It is furthermore preferred if the annulus gear of the planetary transmission is formed as a separate component not permanently connected to the housing. The annulus gear can hereby be replaced simply as required in an advantageous manner.

The planetary transmission can be a component of a multispeed transmission. Provision is in particular made in this respect that the output of the planetary transmission is connected to the input of a further planetary transmission. In this manner, a respective desired step-down ratio can in particular be directly predefined in a relatively wide range.

In an advantageous embodiment of the invention, a respective planetary transmission is arranged on both sides of the drive wheel, with the drive wheel being connected to both sun gears of the planetary transmission. A symmetrical fluid rotation drive can hereby be realized with a simple and inexpensive structure and is in particular of advantage for such cleaning apparatus in which work should be performed with two driven cleaning members, such as rotating brushes or rollers, to achieve a working width which is as large as possible.

The invention additionally relates to a cleaning apparatus having at least one fluid rotation drive of the kind provided here for driving at least one work unit, in particular a working spindle or a cleaning member.

In this respect, the fluid rotation drive can directly drive at least one cleaning member which rotates during operation. It is alternatively possible that no cleaning member is provided as a directly driven work unit, but rather an intermediate member, for example a drive spindle, via which one or more cleaning members are driven. In the latter case, the clearing members do not have to be cleaning members which rotate during operation. The rotation of the intermediate member, for example a working spindle, generated by means of the fluid rotation drive can e.g. also be used to achieve a to and fro movement of a cleaning member.

In a preferred embodiment, a cleaning member, for example a cleaning brush or a cleaning roller, is arranged at both sides of the fluid rotation drive, with the cleaning member being able to be set into motion via a drive shaft, and with the drive shafts of the cleaning members being drivable by means of the fluid rotation drive and being connected to a carrier shaft extending through the fluid rotation drive. A particularly stable structure, for example a double roller or twin roller, can be realised in this manner.

A common carrier structure is preferably provided for the cleaning members and includes a carrier cage which extends along the drive axis of the fluid rotation drive which includes the fluid rotation drive and which is designed as a carrier for central carrier bars of the cleaning members. The housing of the fluid rotation drive can form a component of this carrier cage.

Provision is made in a further embodiment that each carrier bar extends up to and into the region of the free axial end of the cleaning member which is in particular cylindrical.

Each carrier bar can be supported by the carrier cage at least one intermediate region between the fluid rotation drive and the free axial end of the cleaning member. This axial extent of the carrier cage in the direction of the free axial ends of the cleaning members advantageously increases the stability of the total arrangement.

In accordance with a further embodiment of the invention, an axial fluid outlet of the fluid rotation drive is in flow communication with a fluid inlet of the cleaning member, in particular with a carrier bar of the cleaning member. The carrier bar can be made hollow for this purpose. The fluid providing the rotational drive can consequently also be used as a cleaning fluid and thus double. It is in particular possible to supply the fluid emerging from the fluid rotation drive to the interior of a cleaning brush or cleaning roller which rotates in operation and from which it emerges via outlet openings to wet the surface to be cleaned or a part of the brush or roller, in particular the bristles.

Figure 2:
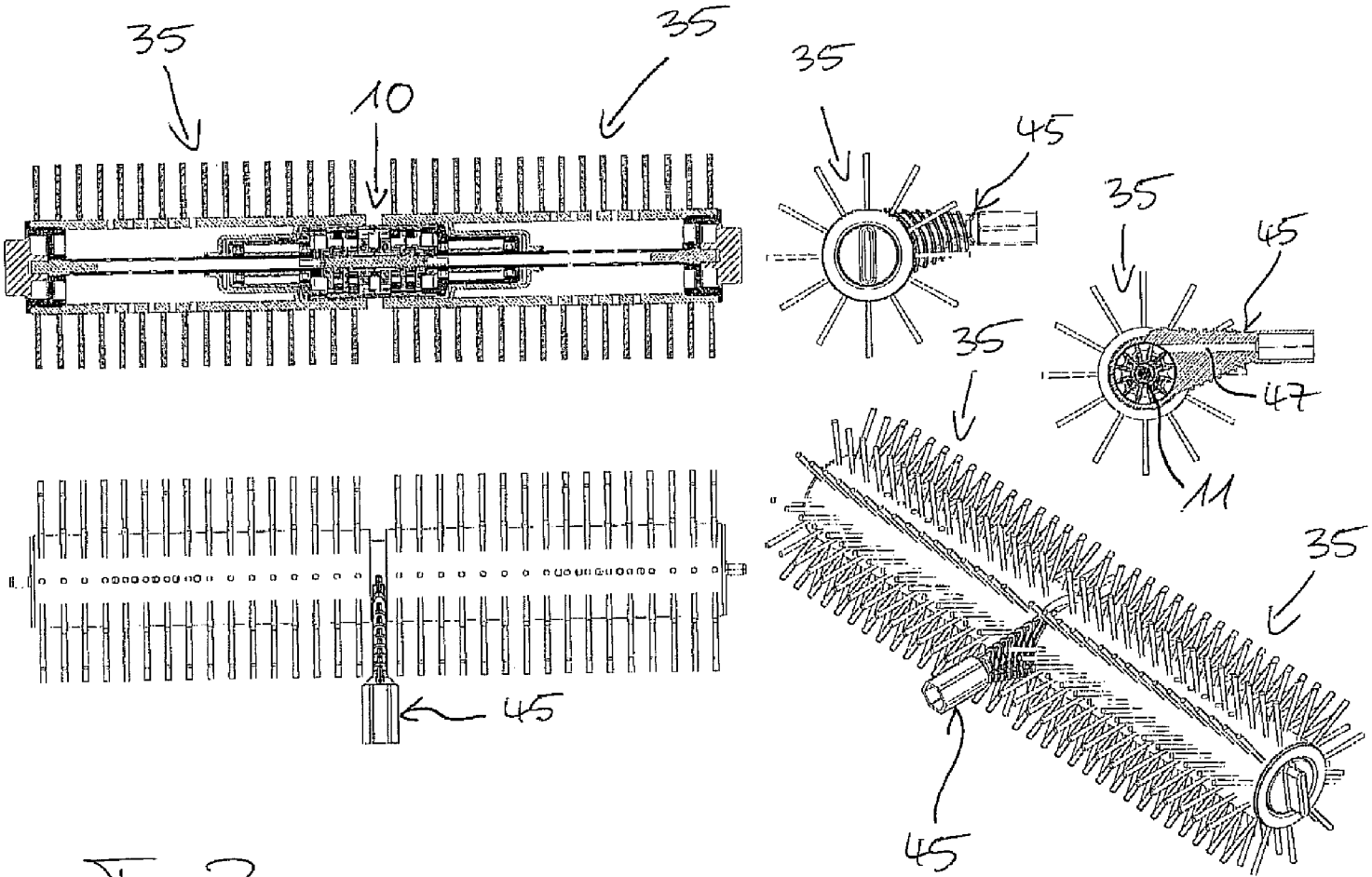
Figure 3:
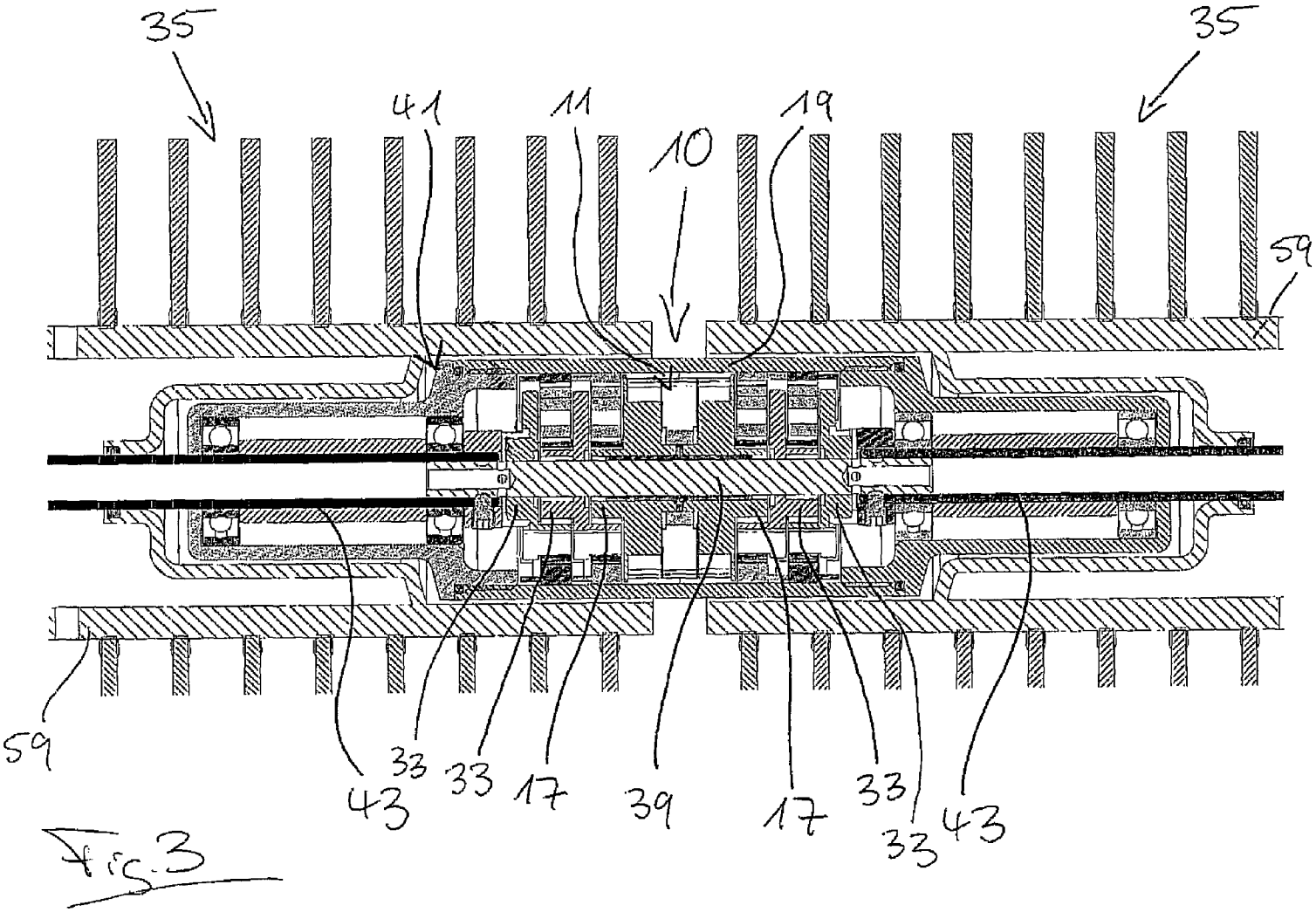
Figure 4:
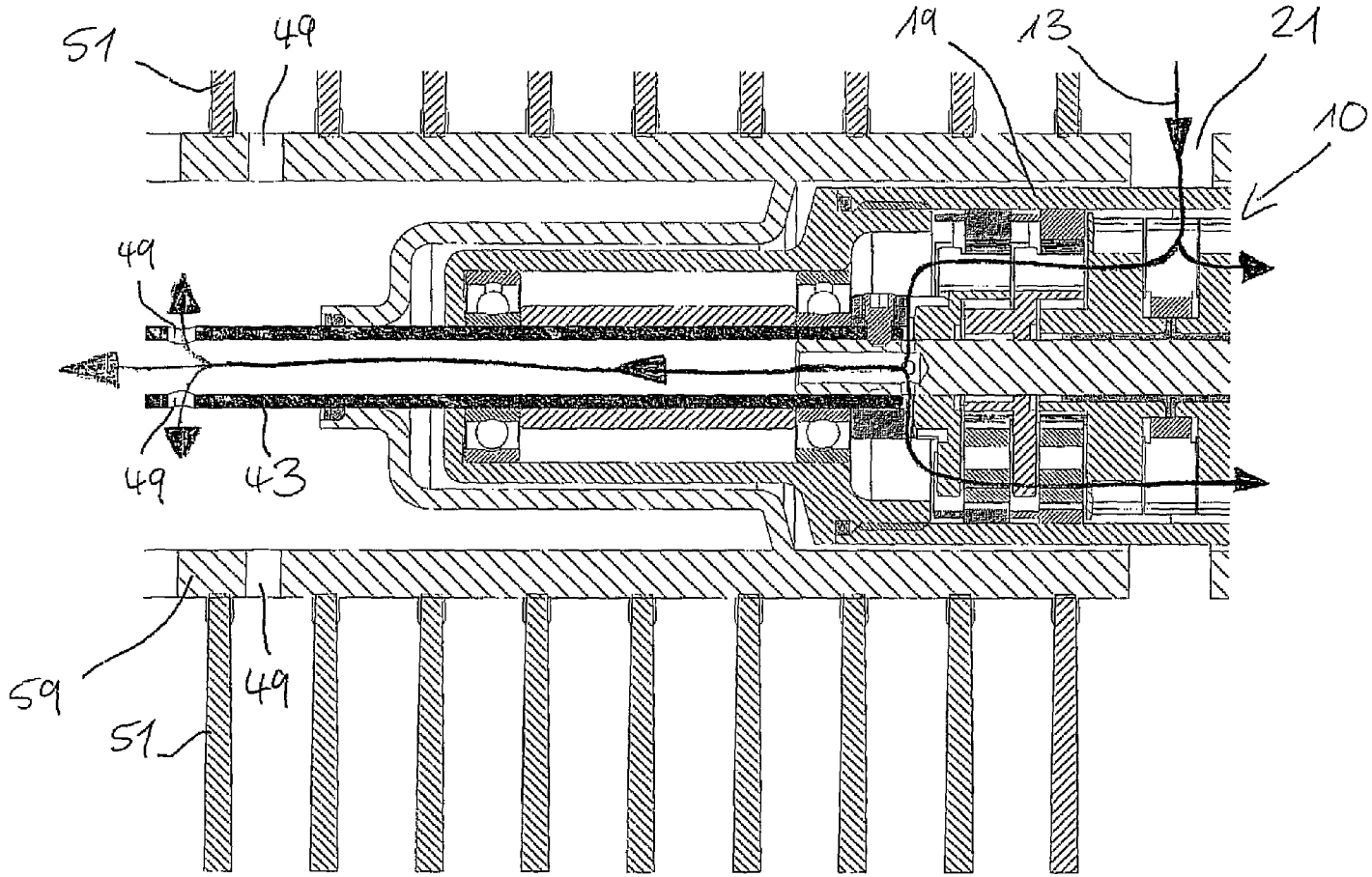
Figure 5:
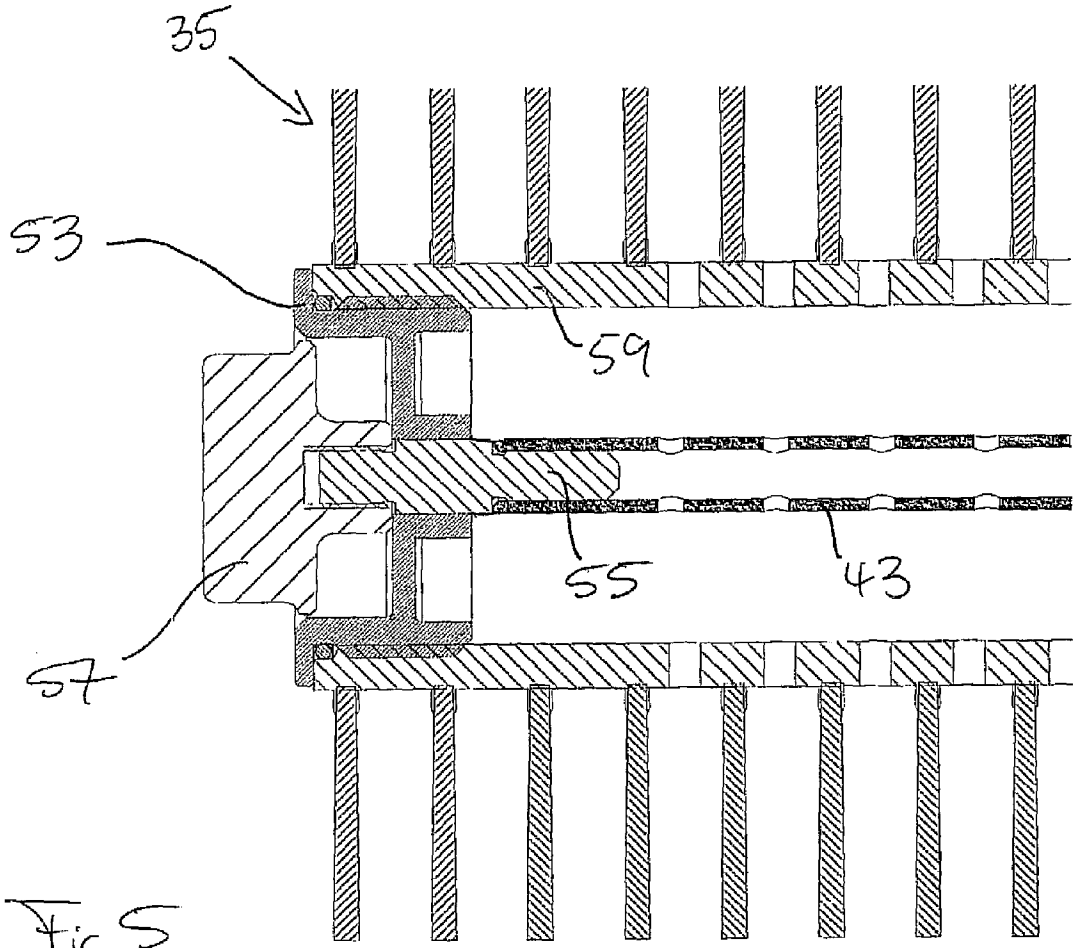
Figure 6:
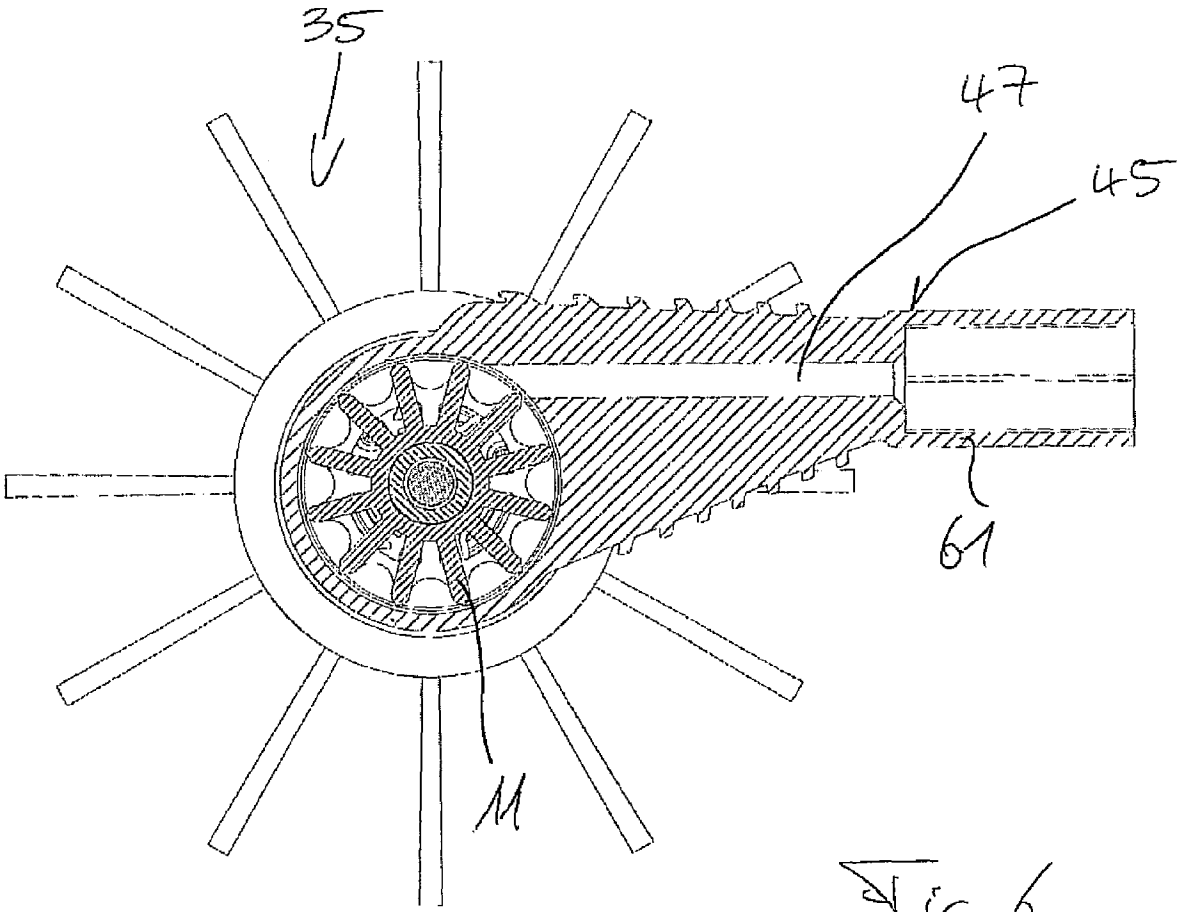

The invention will be described in the following by way of example with reference to the drawing. There are shown:

FIG. 1 schematically, the principle of a fluid rotation drive in accordance with the invention;

FIG. 2 different view of a cleaning apparatus in accordance with the invention;

FIG. 3 in an enlarged representation, the fluid rotation drive of the apparatus of FIG. 2;

FIG. 4 an enlarged part representation of FIG. 3;

FIG. 5 in an enlarged representation, another detail of the apparatus of FIG. 2; and FIG. 6 a section through the apparatus of FIG. 2 extending perpendicular to the drive axle.

The schematic diagram of FIG. 1 shows a drive wheel 11 which is formed as a bucket wheel or turbine wheel and which is rotatable about a drive axis 15. The drive wheel 11 is located in a housing 19 which has a fluid inlet 21. A pressurized fluid 13, in particular water, can be directed in jet form through the inlet 21 onto the drive wheel 11 to set the drive wheel 11 into rotation about the drive axis 15.

Sections projecting axially at both sides of the drive wheel 11 respectively form a sun gear 17 of a planetary transmission. Only an output side of the drive wheel 11 will be described in the following. The sun gear 17 cooperates with planet gears 31 which are attached to a common carrier not shown here. The annulus gear 25 of the planetary transmission cooperating with the planet gears 31 is designed as a separate and thus replaceable component.

The planet gear carrier is set into rotation in accordance with a step-down ratio determined by the respective design, and is thus available as a drive, due to the rotation of the fluid driven drive wheel 11. A further planetary transmission can follow in the drive train. The planet gear carrier can also directly set a work unit, for example a spindle or a cleaning member, into rotation.

The drive wheel 11 and the annulus gear 25 are matched to one another with respect to their diameter such that a first ring region 27 for the fluid 13 which is defined by the drive wheel 11 and the housing 19 and a second ring region 29 for the fluid 13 which is defined by the toothed arrangement 23 of the annulus gear 25 have substantially the same radial spacing from the drive axle 15. In addition, the two ring regions 27, 29 are arranged directly next to one another in the axial direction. The smooth and stable running behavior and rotational speed behavior of this fluid rotation drive in accordance with the invention explained in the description part results from this spatial proximity of the two ring regions 27, 29 in a region moreover surrounded by the housing 19.

The path of the fluid 13 through the drive is indicated purely schematically by the arrow lines in FIG. 1. The fluid 13 flowing in via the inlet 21 moves between the drive wheel 11 and the planetary transmission to an axial outlet 36 where it is available to be supplied, for example, to a driven cleaning member. The drive wheel 11 can be provided with axial openings, not shown. It is in particular possible to design the drive wheel in the manner of a "spoked wheel".

The cleaning apparatus in accordance with the invention shown in FIG. 2 includes a fluid rotation drive 10 in accordance with the invention having a drive wheel 11 and planetary transmissions which are arranged at both sides of the drive wheel 11 and via which rotating cleaning brushes 35 are driven during operation. The fluid supply takes place via a jet member 45 which can be connected to a fluid source, for example to a high pressure cleaner of a conventional kind. The fluid moves via an inlet passage 47 to the inlet 21 of the housing 19 (cf. e.g. FIG. 3). To generate a particularly effective fluid jet for acting on the drive wheel 11, the jet member 45 can include a high-pressure drive nozzle unit which can be inserted and easily replaced e.g. by a quick-plug connection.

A further special feature is the relatively small axial gap between the two cleaning brushes 35 which is provided for the supply of the fluid to the fluid rotation drive and which enables a practically uninterrupted processing of a surface to be cleaned due to its small size, viewed in the axial direction.

It can in particular be seen from FIG. 3 that two planetary transmissions are arranged at each side of the drive wheel 11 and are disposed axially behind one another. The planetary gear carrier 33 of the first planetary transmission serves as a sun gear for the second planetary transmission.

The two axially outer planetary gear carriers 33 each drive a central high carrier bar 43, with the carrier bars 43 serving as drive shafts and being connected to one another via a common central carrier shaft 39 extending through the fluid rotation chive 10.

The housing 19 is a component of a carrier cage 41 which extends in the axial direction, which includes the fluid rotation drive 10 and in which the two hollow carrier bars 43 are rotatably supported.

A respective outer jacket 59 of the respective cleaning brush 35 is supported at the carrier bars 43, and indeed, on the one hand, in the proximity of the free axial end of the carrier cage 41 and, on the other hand, (cf. e.g. FIG. 2) at the free axial end of the cleaning brush 35.

The flow path of the fluid 13 entering via the inlet 21 in the housing 19 is in particular illustrated schematically in FIG. 4. The fluid moves through the fluid rotation drive 10 into the hollow carrier bars 43 in which outlet openings 49 are formed via which the fluid moves into the interior of the outer jacket 59 of the cleaning brush. The fluid can exit the cleaning brush via outlet openings 49 formed in the outer jacket 59 and can wet the surface to be cleaned or the bristles 51 of the cleaning brush.

This arrangement advantageously increases the working weight of the cleaning brushes during the cleaning operation since the hollow space surrounded by the outer jackets 59 is then filled with fluid.

The embodiment shown moreover includes an advantageous brush changing system. The cleaning brushes 35 are each removable from the carrier bar 43 together with a plug 53 (FIG. 5) attached to the end face. The carrier bars 43 are each connected to an axially plugged-in connection piece 55 which remains at the carrier bar 43 after removal of the cleaning brush 35.

A screw member 57 which is screwed onto the connection piece 55 in the connected state is loosened for removing the cleaning brush 35. In the connected state, the outer jacket 59 of the cleaning brush 35 is supported at the carrier bar 43 via the plug 53 and the connection piece 55.

In particular the inlet passage 47 for the fluid extending from a connection section 61 of the jet member 45 to the drive wheel 11 can be seen from FIG. 6.

The cleaning apparatus in accordance with the invention can be held via a fluid supply line, not shown, which is connected to the connection section 61 of the jet member 45.

REFERENCE NUMERAL LIST

10 fluid rotation drive
11 driven wheel
13 fluid
15 drive axle
17 sun gear
19 housing
21 inlet
23 toothed arrangement of the annulus gear
25 annulus gear
27 first ring region
29 second ring region
31 planet gear
33 common carrier
35 cleaning member, cleaning brush
36 outlet
39 carrier shaft
41 carrier cage
43 carrier bar
45 jet member
47 inlet passage
49 outlet opening
51 bristles
53 plug
55 connection piece
57 screw member
59 outer jacket
61 connection section

The invention claimed is:

1. A fluid rotation drive, having at least one drive wheel (11) which can be directly set into rotation about a drive axis (15) by the action of a supplied fluid (13);

at least one planetary transmission, with a sun gear (17) of the planetary transmission being connected to the drive wheel (11); and a housing (19) which includes the drive wheel (11) and the planetary transmission and which has at least one inlet (21) for the fluid supplied for acting on the drive wheel (11), wherein a first ring region (27) for the fluid is defined by the drive wheel (11) and the housing (19), wherein the drive wheel (11) and the housing (19) are arranged such that the fluid, acting on the drive wheel, is brought into a ring flow inside the housing, wherein a second ring region (29) for the fluid is defined by a toothed arrangement (23) of an annulus gear (25) of the planetary transmission; and wherein the first ring region (27) and the second ring region (29) are arranged in direct spatial proximity to one another, such that the ring flow is braked by the toothed arrangement (23) of the annulus gear (25).

2. The fluid rotation device of claim 1, wherein it is used in cleaning apparatus.

3. The fluid rotation device of claim 1, wherein the drive wheel is a turbine wheel.

4. The fluid rotation device of claim 1, wherein the drive wheel is a bucket wheel.

5. The fluid rotation drive of claim 1, wherein the first ring region (27) and the second ring region (29) are arranged directly next to one another in the axial direction.

6. The fluid rotation drive of claim 1, wherein the first ring region (27) and the second ring region (29) have at least substantially the same radial spacing from the drive axle (15).

7. The fluid rotation drive of claim 1, wherein planet gears (31) of the planetary transmission are arranged at a common carrier (33) which can be set into motion by means of the sun gear (17).

8. The fluid rotation drive of claim 1, wherein an axial outlet (36) is provided for the fluid.

9. The fluid rotation drive of claim 1, wherein the annulus gear (25) of the planetary transmission is designed as a separate component not permanently connected to the housing (19).

10. The fluid rotation drive of claim 1, wherein the planetary transmission is a component of a multispeed transmission, with in particular the output of the planetary transmission being connected to the input of a further planetary transmission.

11. The fluid rotation drive of claim 1, wherein a respective planetary transmission is arranged at both sides of the drive wheel (11), with the drive wheel (11) being connected to both sun gears (17) of the planetary transmission.

12. A cleaning apparatus having at least one fluid rotation drive (10) and having at least one drive wheel (11) which can be directly set into rotation about a drive axis (15) by the action of a supplied fluid (13);

at least one planetary transmission, with a sun gear (17) of the planetary transmission being connected to the drive wheel (11); and a housing (19) which includes the drive wheel (11) and the planetary transmission and which has at least one inlet (21) for the fluid supplied for acting on the drive wheel (11), wherein a first ring region (27) for the fluid is defined by the drive wheel (11) and the housing (19), wherein the drive wheel (11) and the housing (19) are arranged such that the fluid, acting on the drive wheel, is brought into a ring flow inside the housing, wherein a second ring region (29) for the fluid is defined by a toothed arrangement of an annulus gear (25) of the planetary transmission; and wherein the first ring region (27) and the second ring region (29) are arranged in direct spatial proximity to one another, such that the ring flow is braked by the toothed arrangement (23) of the annulus gear (25), said fluid rotation device (10) for driving at least one work unit, in particular a drive spindle or a cleaning member (35).

13. The cleaning apparatus of claim 12, wherein a cleaning member (35) is arranged at both sides of the fluid rotation drive (10), with the cleaning member (35) being able to be set into rotation via a drive shaft (43), and with the drive shafts (43) of the cleaning members being drivable by means of the fluid rotation drive (10) and being connected to a carrier shaft (39) extending through the fluid rotation drive (10).

14. The cleaning apparatus of claim 13, wherein the cleaning member (35) is a cleaning brush.

15. The cleaning apparatus of claim 13, wherein the cleaning member (35) is a cleaning roller.

16. The cleaning apparatus of claim 12, wherein a common carrier structure is provided for the cleaning members (35) and includes a carrier cage (41) which extends along the drive axis (15) of the fluid rotation drive (10), includes the fluid rotation drive (10) and which is designed as a carrier for central carrier bars (43) of the cleaning members (35).

17. The cleaning apparatus of claim 16, wherein each carrier bar (43) extends up to and into the region of the free axial end of the cleaning member (35).

18. The cleaning apparatus of claim 16, wherein each carrier bar (43) is supported by the carrier cage (41) at at least one intermediate region between the fluid rotation drive (10) and the free axial end of the cleaning member (35).

19. The cleaning apparatus of claim 12, wherein an axial fluid outlet (36) of the fluid rotation drive (10) is in flow communication with a fluid inlet of the cleaning member (35), in particular with a carrier bar (43) of the cleaning member (35).

20. The cleaning apparatus of claim 12, wherein an axial fluid outlet (36) of the fluid rotation device (10) is in flow communication with a carrier bar (43) of the cleaning member (35).

* * * * *